US007241329B2

(12) United States Patent
Weber

(10) Patent No.: US 7,241,329 B2
(45) Date of Patent: Jul. 10, 2007

(54) METHOD FOR CLEANING AND REGENERATING A PARTICLE FILTER IN A FILTER ASSEMBLY, ASSEMBLY THEREFOR AND ELEMENTS FOR SAID ASSEMBLY

(75) Inventor: Thomas Weber, Chatenois les Forges (FR)

(73) Assignee: Faurecia Systems d'Echappement, Nanterre (FR)

( * ) Notice: Subject to any disclaimer, the term of this patent is extended or adjusted under 35 U.S.C. 154(b) by 728 days.

(21) Appl. No.: 10/311,204

(22) PCT Filed: May 28, 2001

(86) PCT No.: PCT/FR01/01641

§ 371 (c)(1),
(2), (4) Date: Jun. 9, 2003

(87) PCT Pub. No.: WO01/96716

PCT Pub. Date: Dec. 20, 2001

(65) Prior Publication Data

US 2004/0042938 A1 Mar. 4, 2004

(30) Foreign Application Priority Data

Jun. 16, 2000 (FR) ..... 00 07750

(51) Int. Cl.
*B01D 46/00* (2006.01)

(52) U.S. Cl. ..... 95/278; 55/282; 422/178; 134/22.1

(58) Field of Classification Search ..... 95/278, 95/279, 281, 282, 228, 233; 55/282, 284, 55/288, 291, 293, 294–305, DIG. 5, DIG. 30; 422/177–180
See application file for complete search history.

(56) References Cited

U.S. PATENT DOCUMENTS

| | | | | |
|---|---|---|---|---|
| 4,548,625 | A * | 10/1985 | Ishida et al. | 55/282 |
| 5,087,272 | A * | 2/1992 | Nixdorf | 95/20 |
| 6,427,436 | B1 * | 8/2002 | Allansson et al. | 60/274 |
| 6,632,406 | B1 * | 10/2003 | Michelin et al. | 422/178 |

FOREIGN PATENT DOCUMENTS

| | | |
|---|---|---|
| CH | 689 687 | 8/1999 |
| WO | WO 92/18226 | 10/1992 |

* cited by examiner

*Primary Examiner*—Duane Smith
*Assistant Examiner*—Robert Clemente
(74) *Attorney, Agent, or Firm*—Young & Thompson

(57) ABSTRACT

The invention concerns a method which consists in using a single-piece casing (1), without break; then for a first cleaning process, in cutting the casing (1) between the zone (4) containing the filter and the zone (6) containing the other element; then in cleaning the part containing the particle filter; and in assembling once more the two parts, so that the global dimensions of the casing (1) are substantially unchanged.

10 Claims, 3 Drawing Sheets

METHOD FOR CLEANING AND REGENERATING A PARTICLE FILTER IN A FILTER ASSEMBLY, ASSEMBLY THEREFOR AND ELEMENTS FOR SAID ASSEMBLY

FIELD OF THE INVENTION

The present invention relates to a method permitting the cleaning of a particle filter located on an exhaust line of an internal combustion engine.

BACKGROUND OF THE INVENTION

Assemblies for filtering particles and regenerating by post-combustion on a catalyst comprise, on the one hand, a particle filter and, on the other hand, a post-combustion catalyst, those two elements being located in a single metal casing having an upstream inlet opening for receiving the gases coming from the engine and a downstream opening for discharging the gases after filtration and regeneration by post-combustion. In general, the particle filter is placed downstream of the post-combustion catalyst in the casing, so that the gases coming from the engine first pass through the post-combustion catalyst before arriving at the particle filter.

After some time in use, it is necessary to clean the particle filter of the combustion residues, especially the residues of fuel additives, which accumulate on the filter. This cleaning operation is carried out especially by spraying water and air, which enables the residues to be detached and dissolved. If this cleaning operation is carried out in the casing assembly comprising the post-combustion catalyst and the particle filter, there is a risk that the post-combustion catalyst will be damaged. Furthermore, the cleaning quality is not optimum.

In order to avoid damage to the post-combustion catalyst and in order to clean the particle filter only, it is known to manufacture the casing in two successive portions, the one containing the particle filter and the other the post-combustion catalyst, the two portions being assembled one on each side of a separation plane by assembly means, such as a system of flanges welded to the surface of each of the two portions of the casing. It is thus possible to separate the two portions in order to clean the portion containing the particle filter.

Since it is absolutely necessary to maintain complete sealing at the site of the separation, it is necessary to use solid flanges clamping between them a seal placed between the flanges. The securing of the flanges necessitates the use of a large number of screws with nuts, all of which measures increase the cost and the radial space requirement of the assembly.

The present invention proposes to overcome those disadvantages.

SUMMARY OF THE INVENTION

The invention relates to a method for cleaning a particle filter located in an assembly capable of containing, in addition to the filter, at least one other element, such as a post-combustion catalyst, which is axially offset in one and the same casing which is to be arranged on an exhaust line of an internal combustion engine, characterised in that a casing produced in a single piece, without separation, is used, in that subsequently, for a first cleaning operation, the casing is cut between the filter and the other element, then the portion containing the particle filter is cleaned and the two portions are joined again, in such a manner that the overall dimensions of the casing remain substantially unchanged.

What is meant by substantially unchanged overall dimensions is that the dimensions, and especially the length, are not modified in such a manner as to impair or modify substantially the functioning of the assembly.

Preferably, the variation in length does not exceed 1 cm, and more preferably 0.5 cm.

It is even possible to provide that the length remains the same, thanks to a carefully selected brace.

The two portions are joined preferably by welding at the location of the line of separation between the two portions, but other means, for example adhesive bonding, are possible.

Preferably, the two portions are joined by means of an annular brace which is advantageously inserted between the two portions of the casing. However, it is also possible to use an annular brace in which the two portions of the casing are fitted together.

The final securing at the location of the brace is effected preferably by welding. The brace also has the advantage of facilitating the arrangement of the two portions of the casing side by side and of avoiding welding projections inside the casing.

If it is later desired to carry out a fresh cleaning operation, the casing is cut again next to the first cut, especially next to the brace, the cleaning operation is carried out and then the two cut portions of the casing are re-assembled, preferably by means of a second brace which is then welded between the portions. It is optionally possible to proceed in the same manner for other later cleaning operations.

Preferably, in the method according to the invention, a brace is used which has, for example at its periphery, a raised portion which is to be inserted between the ends of the two casing portions to be joined and to hold them at a precise distance from one another. The raised portion may be formed, for example, by a peripheral collar located in the central portion of the brace, or by tabs or cut-outs disposed at several angularly spaced locations.

The casing thus reconstructed may therefore preserve a constant length, if the peripheral raised portion has a thickness identical to the length of the loss of material resulting from cutting, or, in any case, a length close to the initial length of the casing. In addition, after cleaning, the casing has only a small increase in radial space requirement, which in fact corresponds to the thickness of a weld seam.

Finally, owing to the use of those raised portions, the assembly thus reconstructed exhibits very good sealing and excellent mechanical strength.

The invention relates also to the use of a casing which is produced in a single piece, that is to say, without previous separation, and which contains the particle filter and another element, such as, in particular, a post-combustion catalyst, for implementing the cleaning method according to the invention.

The invention relates also to the assembly comprising the casing reconstructed by welding on each side of a brace after a cleaning operation.

The invention relates also to the braces made suitable for implementing the method according to the invention.

BRIEF DESCRIPTION OF THE DRAWINGS

Other advantages and features will emerge on reading the following description which is given by way of non-limiting example with reference to the appended drawings in which.

Figure 1:
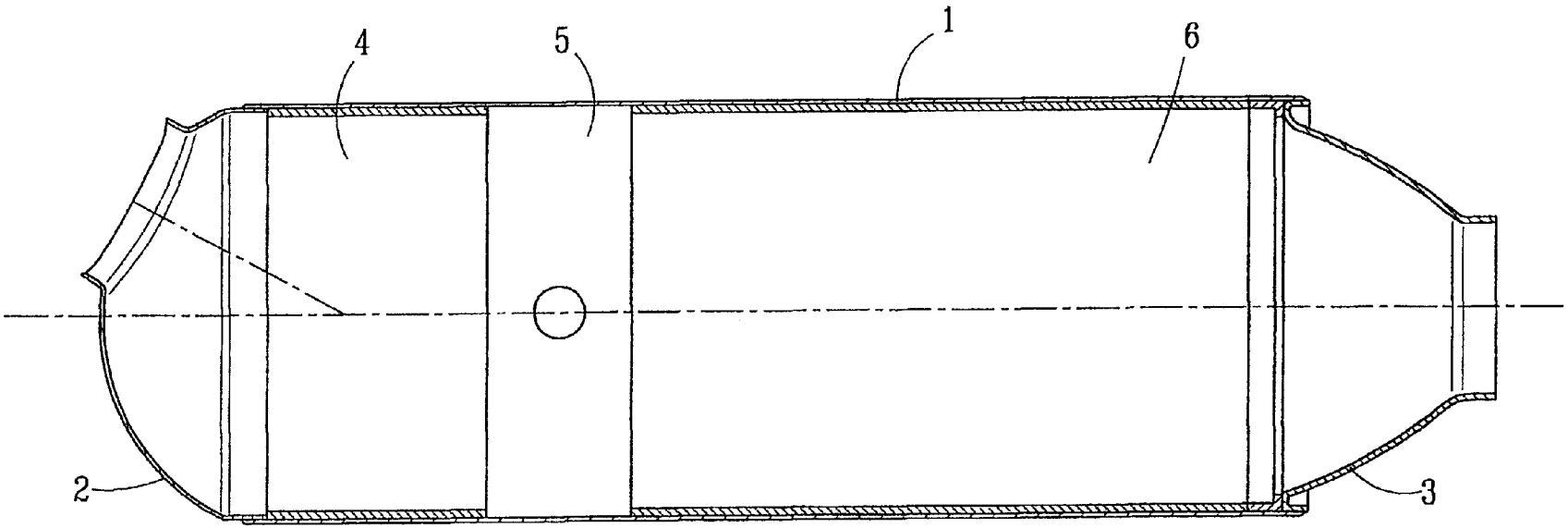
FIG. 1 is a view of the initial casing before cleaning.

Reference will first of all be made to FIG. 1.

DETAILED DESCRIPTION OF THE INVENTION

This Figure shows a particle filter and post-combustion catalyst assembly comprising a cylindrical metal casing 1 receiving, at one of its ends, an upstream connection piece 2 and, at its end, a further, downstream, connection piece 3, the assembly being placed on an exhaust line of an internal combustion engine. The inside of the casing is divided into three zones, 4, 5 and 6, zone 4 containing the post-combustion catalyst and the portion 6 the particle filter. The intermediate zone 5 does not possess any internal covering or element and therefore simply constitutes a transition zone between zones 4 and 6. It may comprise a temperature probe socket.

Figure 5:
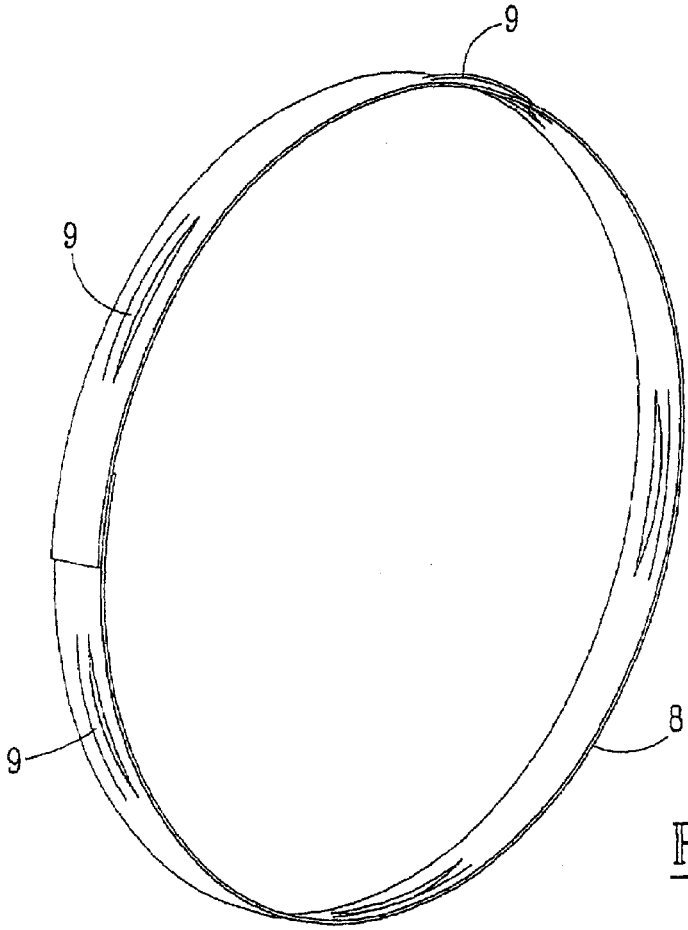
FIG. 5 is a perspective view of a particular brace according to the invention.

When it is deemed necessary to clean the particle filter, a circular cut is made in the plane 7, which enables the two pieces or portions of the casing to be separated, the one containing zone 4 and a short portion of zone 5 and the other containing zone 6 and the majority of zone 5. When the particle filter has been cleaned, the two portions thus cut are re-assembled by fitting them around an annular brace 8 which, as can be seen in FIG. 5, may be produced, for example, by rolling and welding a metal strip cut beforehand. Those operations are carried out after having separated the assembly 1 from the exhaust line of the engine.

Figure 2:
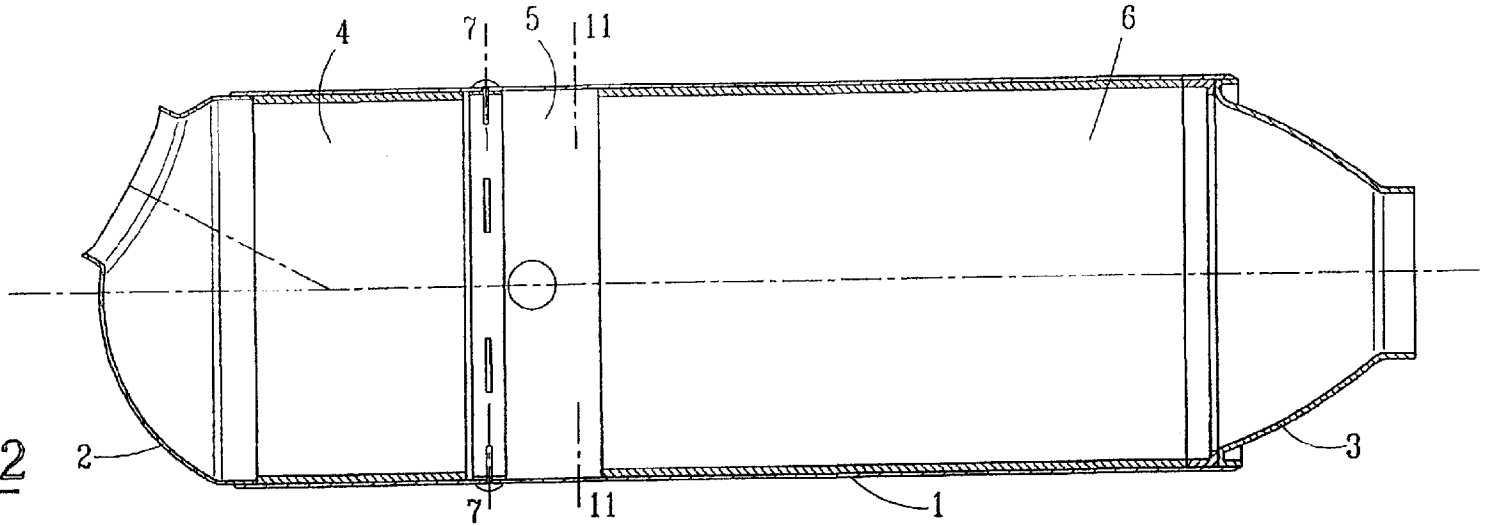
FIG. 2 is a view in axial section of an assembly after a first cleaning operation.

In the embodiment shown in FIGS. 2 and 5, the brace 8 receives, at its surface, slits or semi-cutouts 9 which form peripheral raised portions located in the middle of the brace, those raised portions acting as an abutment for the ends of the two pieces of the casing 1 which will result from the separating operation. Once the two pieces have been fitted on the annular brace 7, one on each side and in respective contact with the raised portions 9, a peripheral weld seam 10 which completes the mechanical strength and ensures sealing is made.

The assembly obtained is represented in FIG. 2.

If, later on, it is again desired to carry out a fresh cleaning operation on the particle filter, a fresh separation is made by cutting, this time in a plane 11 in zone 5, at a distance from the brace 8. Two casing portions are thus obtained again and it is possible to carry out the cleaning of the particle filter. The two portions are again re-joined, this time using, at the location of the separation plane 11, a second brace, for example a brace 8, the two portions resulting from the cutting operation again being re-joined and welded as above, this time around the new brace.

Figure 3:
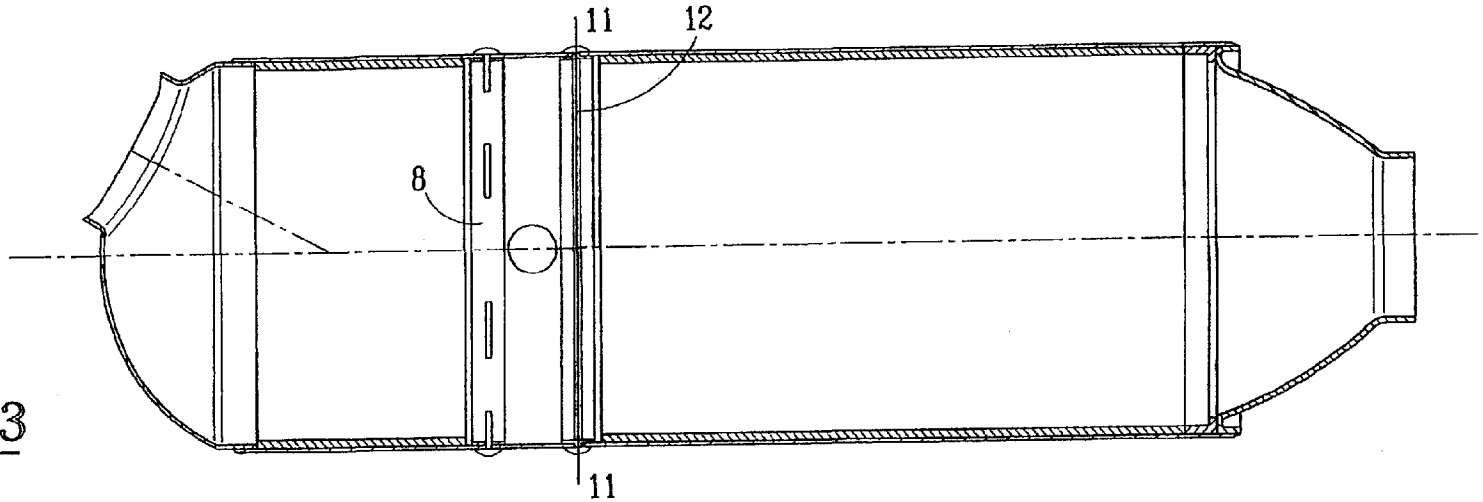
FIG. 3 is a view of this assembly after a second cleaning operation.
Figure 4:
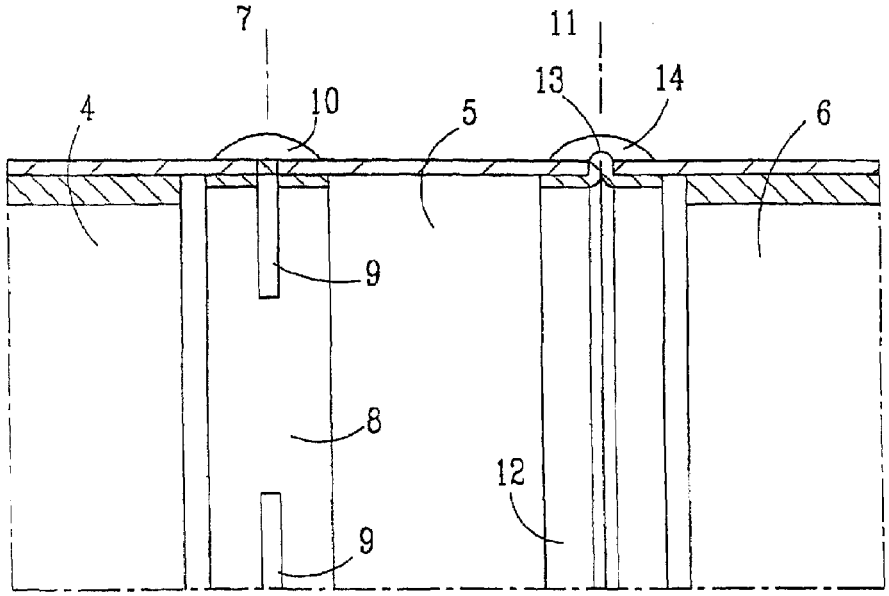
FIG. 4 is an enlarged view at the location of the braces of FIG. 2.

FIGS. 3 and 4 show the assembly that is obtained after the second cleaning operation, and for which, by way of example, a brace 12, different from a brace 8, has been used, the brace 12 having, instead of a given number of semi-cutouts such as 9, a central peripheral collar 13 playing the same role of abutment and spacer. The weld seam 14 joins the portions 5 and 6 again on each side of the brace 12.

The invention claimed is:

1. Method for cleaning a particle filter located in an assembly capable of containing, in addition to the filter, at least one other element, in particular a post-combustion catalyst, which is axially offset in one and the same casing (1), characterised in that a casing (1) produced in a single piece, without separation, is used, in that subsequently, for a first cleaning operation, the casing (1) is cut between the zone (6) containing the filter and the zone (4) containing the other element, then the portion containing the particle filter is cleaned and the two portions are joined again, in such a manner that the overall dimensions of the casing (1) remain substantially unchanged.

2. Method according to claim 1, characterised in that the two portions are joined by welding.

3. Method according to claim 1, characterised in that a casing (1) is used which defines, between the zones (6) of the filter and (4) of the other element, an intermediate zone (5) in which the casing is cut.

4. Method according to claim 1, characterised in that the two portions of the casing are joined by means of an annular brace (8, 12).

5. Method according to claim 4, characterised in that the brace (8, 12) is inserted between the two portions of the casing.

6. Method according to claim 1, characterised in that, in order later to carry out an additional cleaning operation, the casing is cut again next to the first cut and therefore next to the brace (8, 12) if it exists, the cleaning operation is carried out and then the two cut portions of the casing are joined again, optionally on a second brace (8, 12).

7. Method according to claim 4, characterised in that there is used, as the brace, a brace (8, 12) having, at its external periphery, a raised portion which is to be inserted between the ends of the two casing portions to be joined and which is to hold them at a precise distance from one another.

8. Method according to claim 7, characterised in that the raised portion is formed by partial cut-outs at several angularly spaced locations (9).

9. Method according to claim 7, characterised in that the raised portion is formed by a peripheral collar (13) on the brace.

10. Method according to claim 7, characterised in that the thickness of the raised portion is substantially identical to the length of the loss of material resulting from cutting the casing.

* * * * *